US006168463B1

(12) United States Patent
Wu

(10) Patent No.: US 6,168,463 B1
(45) Date of Patent: Jan. 2, 2001

(54) ELECTRICAL CONNECTOR RETENTION DEVICE

(75) Inventor: Kun-Tsan Wu, Tu-Chen (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/399,936

(22) Filed: Sep. 21, 1999

(30) Foreign Application Priority Data

Dec. 31, 1998 (TW) ..... 87222073

(51) Int. Cl.[7] ..... H01R 13/73
(52) U.S. Cl. ..... 439/567
(58) Field of Search ..... 439/567, 571, 439/572

(56) References Cited

U.S. PATENT DOCUMENTS 5,407,364 * 4/1995 Tzeng et al. ..... 439/567
5,520,551 * 5/1996 Broschard, III ..... 439/567
5,591,048 * 1/1997 Hahn ..... 439/567
5,664,965 * 9/1997 Clark et al. ..... 439/567
5,738,541 * 4/1998 Tseng ..... 439/567
5,899,771 * 5/1999 Clark et al. ..... 439/567

* cited by examiner

*Primary Examiner*—Gary F. Paumen
(74) *Attorney, Agent, or Firm*—Wei Te Chung

(57) ABSTRACT

An electrical connector retention device for retaining a connector on a circuit board comprises a mounting portion connected to a housing of the connector and an engaging portion received in an aperture of the circuit board. The engaging portion comprises first and second legs each having left and right interfering portions positioned at different vertical levels. The interfering portions on the same sides of the first and second legs are also positioned at different vertical levels. When the connector is mounted to a circuit board having a smaller thickness, the interfering portions of the engaging portion positioned at a high vertical level engage with a periphery of the aperture of the housing to establish reliable engagement therebetween. When the connector is mounted to a circuit board having a large thickness, the interfering portions of the engaging portion positioned at both high and low vertical levels engage with a periphery of the aperture of the housing to establish reliable engagement therebetween.

5 Claims, 5 Drawing Sheets

ELECTRICAL CONNECTOR RETENTION DEVICE

BACKGROUND OF THE INVENTION

The present invention relates to an electrical connector retention device for retaining an electrical connector on a circuit board.

Electrical connectors are generally connected to a circuit board by board locks. Referring to FIG. 1, a conventional board lock 7 comprises a base 71 and a pair of spring legs 72 extending from one edge of the base 71 with a gap 74 defined therebetween. A projection 73 is provided at a free end of each leg 72. Accordingly, an electrical connector mounted to a circuit board 9 comprises a dielectric housing 8 having a pair of recesses 81. The housing 8 further defines a cavity 83 in communication with the recess 81 and a shoulder 82 between the cavity 83 and the recess 81. The circuit board 9 defines a pair of through holes 91 corresponding to the cavities 83 of the housing 8. In operation, the board lock 7 joins the housing 8 and the circuit board 9 together with the base 71 received in the recess 81 and the legs 72 extending through both the cavity 83 and the through hole 91. The base 71 abuts against the shoulder 82 and the projections 73 engage with a bottom face of the circuit board 9 thereby retaining the housing 8 on the circuit board 9.

However, as seen in FIG. 2, the conventional board lock 7 does not function properly when the housing 8 is mounted to another circuit board 9' having a smaller thickness than the circuit board 9. The projections 73 are distanced from a bottom face of the circuit board 9'. Thus, the board lock 7 is vertically movable and connection between the housing 8 and the circuit board 9' is not reliable. Hence, an improved electrical connector is required to overcome the disadvantages of the prior art.

BRIEF SUMMARY OF THE INVENTION

An object of the present invention is to provide an electrical connector retention device for mounting a connector to circuit boards having different thicknesses.

Accordingly, an electrical connector retention device for retaining a connector on a circuit board comprises a mounting portion connected to a housing of the connector and an engaging portion received in an aperture of the circuit board. The engaging portion comprises first and second legs each having left and right interfering portions positioned at different vertical levels. The interfering portions on the same sides of the first and second legs are also positioned at different vertical levels. When the connector is mounted to a circuit board having a smaller thickness, the interfering portions of the engaging portion positioned at a high vertical level engage with a periphery of the aperture of the housing to establish reliable engagement therebetween. When the connector is mounted to a circuit board having a larger thickness, the interfering portions of the engaging portion positioned at both high and low vertical levels engage with a periphery of the aperture of the housing to establish reliable engagement therebetween.

Other objects, advantages and novel features of the invention will become more apparent from the following detailed description of the present embodiment when taken in conjunction with the accompanying drawings.

DETAILED DESCRIPTION OF THE INVENTION

Figure 1:
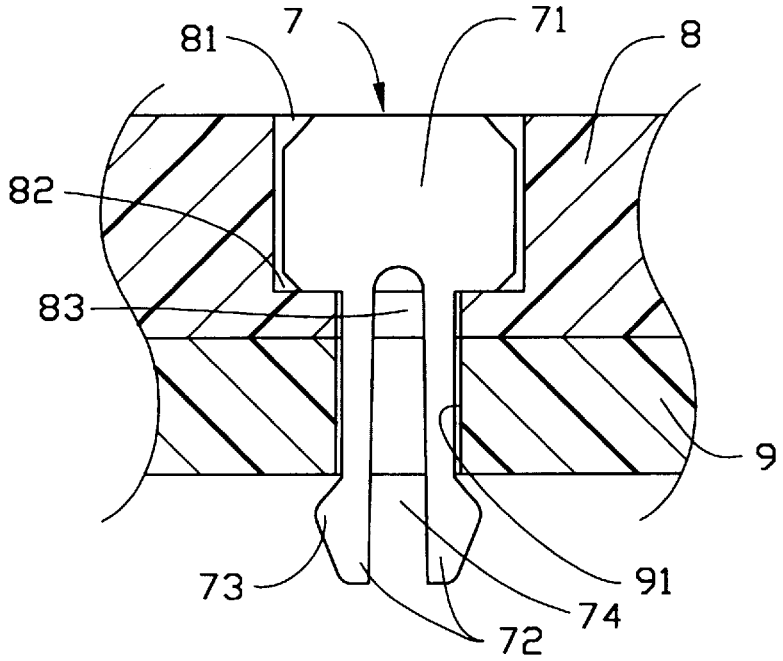
FIG. 1 (PRIOR ART)
FIG. 1 is a cross-sectional view showing the connection between a housing and a circuit board by a conventional board lock.
Figure 2:
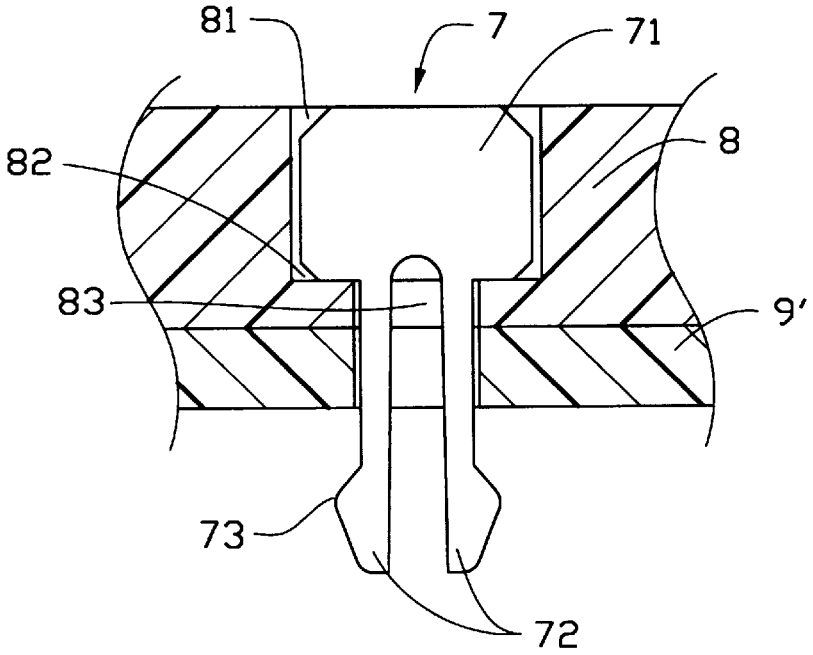
FIG. 2 (PRIOR ART)
FIG. 2 is similar to FIG. 1 showing a thinner circuit board.
Figure 3:
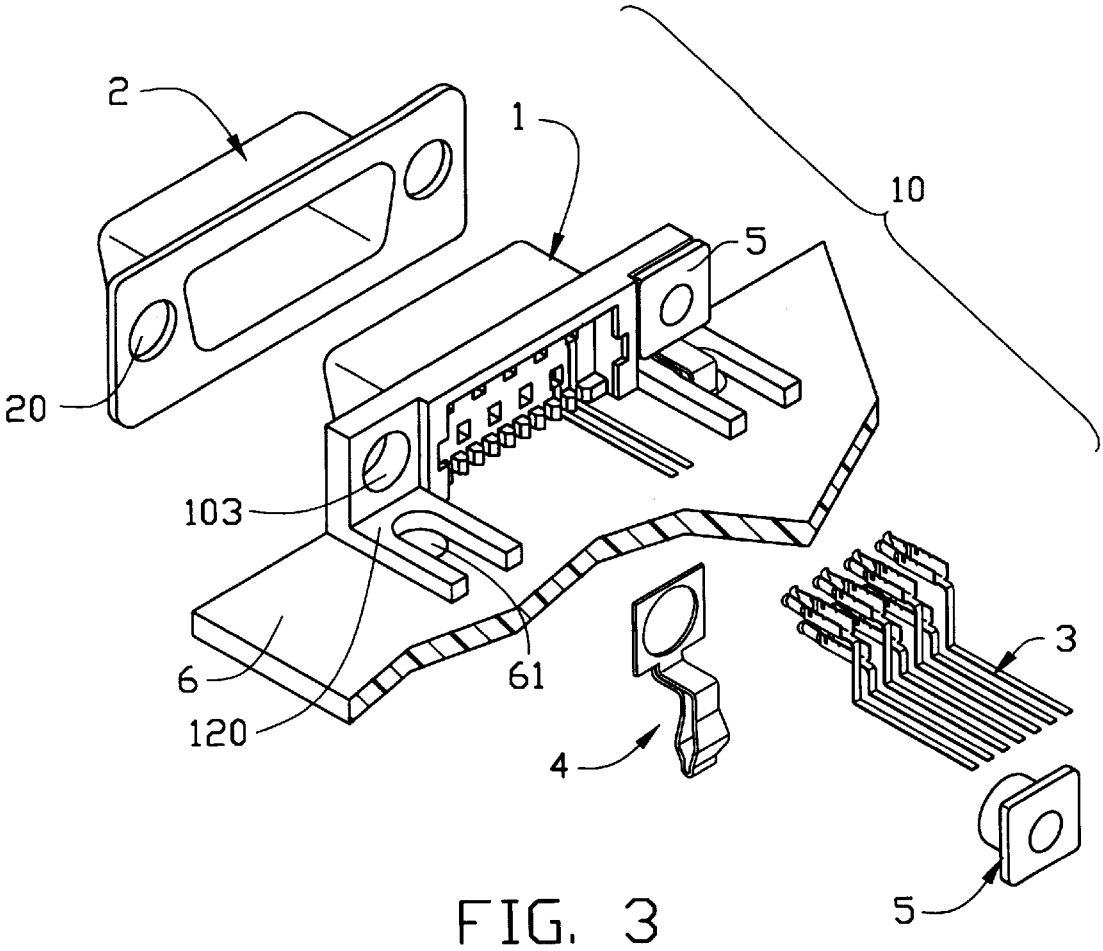
FIG. 3 is an exploded view of a connector to be mounted to a circuit board by a pair of retention devices of the present invention.

Referring to FIG. 3, a retention device 4 of the present invention is configured to retain an electrical connector 10 to a circuit board 6. The connector 10 comprises a dielectric housing 1, a shield 2 covering a mating portion of the housing 1, and a plurality of contacts 3 received in the housing 1. The housing 1 defines a pair of cavities 103 parallel to the circuit board 6 in an axial direction in opposite ends thereof. The housing 1 also provides a pair of U-shaped protrusions 120 at a bottom thereof backward extending therefrom for secure position of the housing 1 on the circuit board 6. The shield 2 defines a pair of apertures 20 corresponding to the cavities 103 of the housing 1. The circuit board 6 defines a pair of holes 61 spaced a distance equal to the distance between the U-shaped protrusions 120 of the housing 1.

Figure 4:
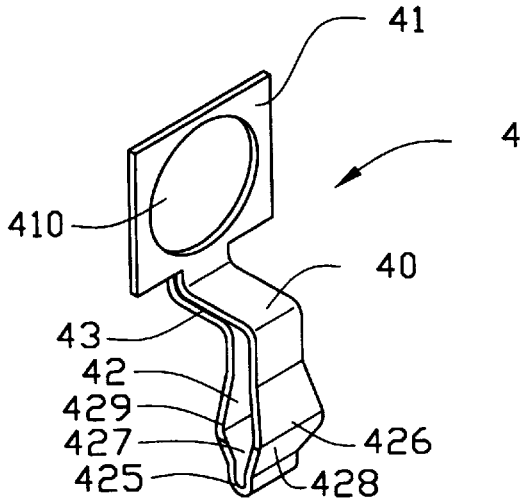
FIG. 4 is a perspective view of the retention device of the present invention.

The retention device 4, as shown in FIG. 4, comprises a mounting portion 41 defining a hole 410 and an engaging portion 42 for engaging with the corresponding hole 61 of the circuit board 6. The retention device 4 is assembled to the housing 1 with a supporting portion 43 (described in detail later) thereof abutting against the protrusion 120 of the housing 1. A nut 5 extending through the hole 410, the cavity 103 and the aperture 20 rivets the retention device 4, the housing 1 and the shield 2 together.

Figure 5:
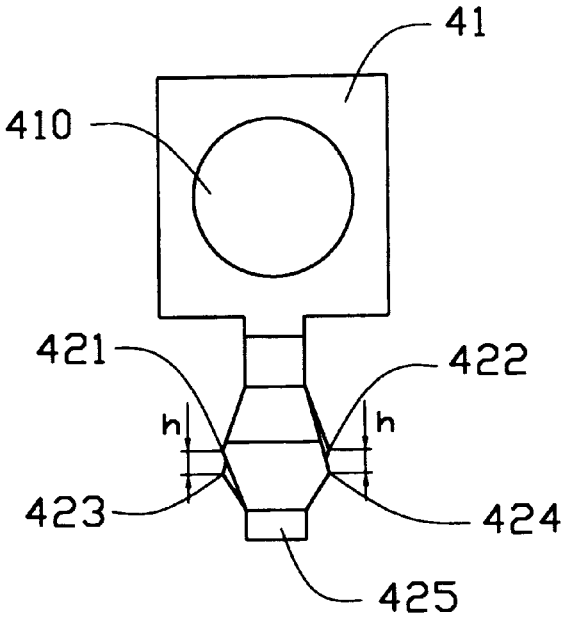
FIG. 5 is a front view of FIG. 4.
Figure 6:
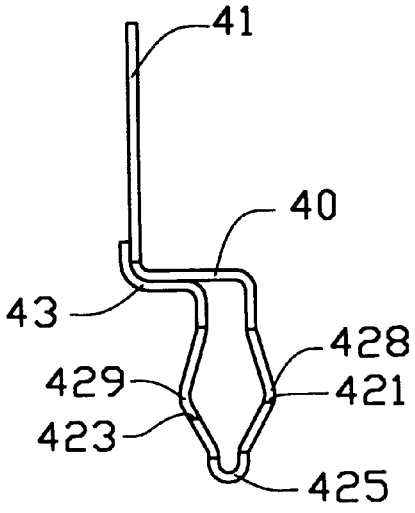
FIG. 6 is a side view of FIG. 4.

Referring to FIGS. 4, 5 and 6, the engaging portion 42 comprises first and second spring legs 426, 427 respectively positioned at a front position and a rear position thereof. The first and second spring legs 426, 427 respectively form left and right interfering portions 421, 423 and 424, 422 on opposite sides thereof. The left interfering portion 421 is positioned at a height of "h" above the right interfering portion 424 and the left interfering portion 423 is positioned below the right interfering portion 422 also by a height "h". The left interfering portion 421 of the first leg 426 is positioned above the left interfering portions 423 of the second leg 427 and the right interfering portion 424 of the first leg 426 is positioned below the right interfering portion 422 of the second leg 427. However, a horizontal distance between the left and right interfering portions 421, 424 of the first leg 426 is substantially equal to a horizontal distance between the left and right interfering portions 423, 422 of the second leg 427. The first and second legs 426, 427 each are outwardly stamped to form an outwardly expanding arcuate portion 428, 429 to provide further reliable engagement between the circuit board 6 and the engaging portion 42. The first and second legs 426, 427 are connected at free ends thereof adjacent the arcuate portions 428, 429 by a joining segment 425. The retention device 4 further comprises a connecting portion 40 between the mounting portion 41 and the engaging portion 42 whereby the engaging portion 42 is distanced from the mounting portion 41. The second leg 427 forms the supporting portion 43 abutting against the connecting portion 40 for strengthening the retention device 4.

Figure 7:
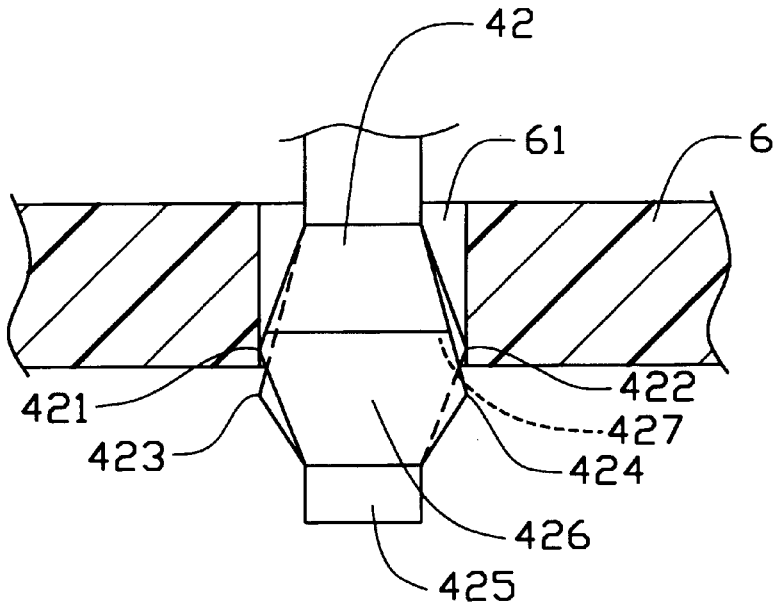
FIG. 7 is a cross-sectional view of the retention device of the present invention engaging with a circuit board.
Figure 8:
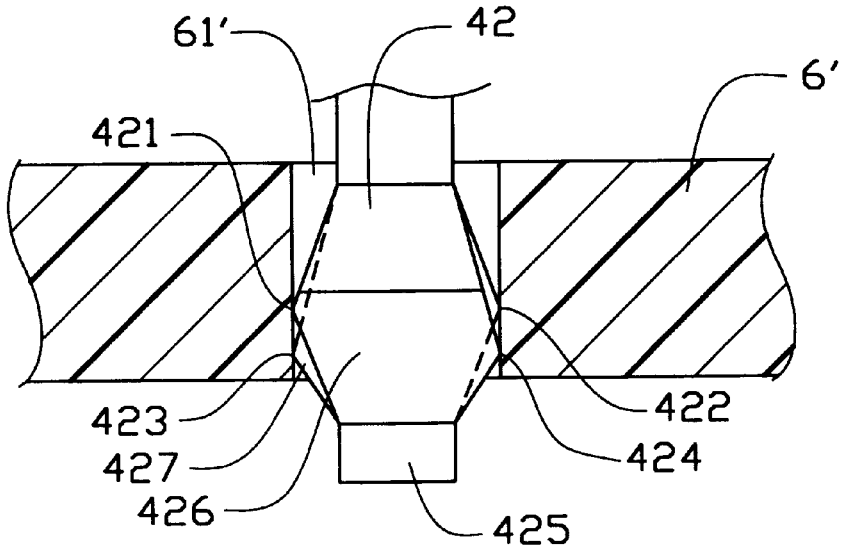
FIG. 8 is a view similar to FIG. 7 but showing the retention device engaged with a thicker circuit board.
Figure 9:
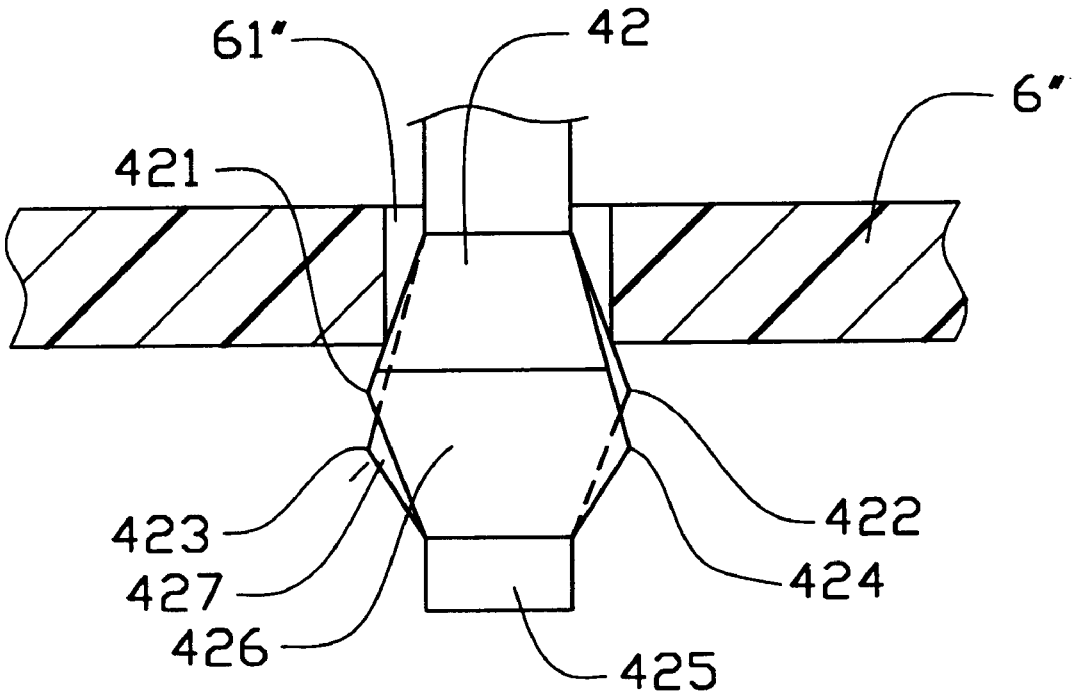
FIG. 9 is a view similar to FIG. 7 showing the retention device engaged with a thinner circuit board.

Referring to FIGS. 7–9, when the engaging portion 42 of the retention device 4 is received in the holes 61 of the circuit board 6 having a certain thickness, the first and second legs 426, 427 are inwardly pressed by the periphery of the hole 61 to move toward each other and the left and right interfering portions 421, 422 interferentially engage with the periphery of the hole 61. When the engaging portion 42 of the retention device 4 is received in the holes 61' of the circuit board 6' having a larger thickness than the circuit board 6, the first and second legs 426, 427 are inwardly pressed by the periphery of the hole 61' to move toward each other and the interfering portions 421, 422, 423, 424 interferentially engage with the periphery of the hole 61'. When the engaging portion 42 of the retention device 4 is received in the holes 61" of the circuit board 6" having a smaller thickness than the circuit board 6, the first and second legs 426, 427 are inwardly pressed by the periphery of the hole 61" to move toward each other and the interfering portions 421, 422 abutting against a bottom of the circuit board 6". Therefore, the retention device 4 is adapted for securely engaging with circuit boards having variable thicknesses.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A retention device for retaining an electrical connector on a circuit board comprising:

a mounting portion adapted to be mounted to a connector housing; and an engaging portion adapted to be engaged with a hole provided on a circuit board, the engaging portion comprising first and second spring legs connected at lower ends thereof, each spring leg having an interfering portion on each of two opposite sides thereof, the interfering portions of at least one of the first and second spring legs being positioned at different vertical levels;

wherein the interfering portions on same sides of the first and second spring legs are positioned at different vertical levels;

wherein the interfering portion on one side of the first spring leg is positioned above the interfering portion on the same side of the second spring leg and the interfering portion on the other side of the first spring leg is positioned below the interfering portion on the same other side of the second spring leg;

wherein a horizontal distance between the two interfering portions of the first spring leg is substantially equal to a horizontal distance between the two interfering portions of the second spring leg;

wherein the first and second spring legs each are outwardly stamped to form an outwardly bulged arcuate portion.

2. The retention device as claimed in claim 1, wherein the engaging portion is offset a predetermined distance from the mounting portion and a connecting portion is provided between the engaging portion and the mounting portion.

3. An electrical connector for being mounted to a circuit board, comprising:

a dielectric housing receiving a plurality of contacts; and a retention device having a mounting portion secured to the dielectric housing and an engaging portion adapted to be engaged with a hole provided on the circuit board, the engaging portion comprising a first and a second spring legs connected at free ends thereof and positioned at front and rear positions, respectively each of the first and second spring legs having a left interfering portion and a right interfering portion on left and right sides thereof, the left and right interfering portions of the same spring leg being positioned at different vertical levels;

wherein the left interfering portion of the first spring leg is positioned above the left interfering portion of the second spring leg and the right interfering portion of the first spring leg is positioned below the right interfering portion of the second spring leg;

wherein the horizontal distance between the two interfering portions of the first spring leg is substantially equal to the horizontal distance between the two interfering portions of the second spring leg;

wherein the first and second spring legs each are outwardly stamped to form an outwardly bulged arcuate portion;

wherein the engaging portion of the engaging device is received in the hole of the circuit board, the left and right interfering portions of the first and second spring legs interfering with the periphery of the hole.

4. The electrical connector as claimed in claim 3, wherein the engaging portion of the engaging device is offset a predetermined distance from the mounting portion of the engaging device and a connecting portion is provided between the engaging portion and the mounting portion.

5. A retention device for retaining an electrical connector to a circuit board, comprising:

a mounting portion adapted to be mounted to a connector housing;

an engaging portion connected to said mounting portion and adapted to be engaged within a hole provided in the circuit board, said engaging portion comprising first and second spring legs with respectively two outwardly expanding arcuate portions opposite to each other, each of said first and second spring legs further including a protruding interfering portion on one of two opposite sides thereof; wherein said interfering portion is positioned below said expanding arcuate portion;

wherein each of said first and second spring legs further includes another protruding interfering portion on the other of said two opposite sides thereof, and wherein both said two interfering portions are positioned at two different vertical levels;

wherein both said two protruding interfering portions are positioned below the expanding arcuate portion of the corresponding spring leg.

* * * * *